US010570594B2

(12) United States Patent
Karnegie et al.

(10) Patent No.: US 10,570,594 B2
(45) Date of Patent: Feb. 25, 2020

(54) HAIR STRAINING DEVICE

(71) Applicant: Juka Innovations Corporation, Farmingdale, NY (US)

(72) Inventors: Serge Karnegie, Glen Cove, NY (US); Solyman Najimi, Farmingdale, NY (US)

(73) Assignee: Juka Innovations Corporation, Farmingdale, NY (US)

( * ) Notice: Subject to any disclaimer, the term of this patent is extended or adjusted under 35 U.S.C. 154(b) by 50 days.

(21) Appl. No.: 15/464,576

(22) Filed: Mar. 21, 2017

(65) Prior Publication Data

US 2018/0274218 A1 Sep. 27, 2018

(51) Int. Cl.
*E03C 1/262* (2006.01)

(52) U.S. Cl.
CPC ..... *E03C 1/262* (2013.01)

(58) Field of Classification Search
CPC ..... E03C 1/262; E03C 1/264
USPC ..... 4/291–292, 286
See application file for complete search history.

(56) References Cited

U.S. PATENT DOCUMENTS

| | | | | |
|---|---|---|---|---|
| D394,213 | S | 12/1888 | Scannell | |
| 769,001 | A | 8/1904 | Lawrence | |
| D989,410 | | 4/1911 | Peters | |
| 1,424,022 | A | 7/1922 | Lacoste | |
| 1,436,294 | A | 11/1922 | Scott | |
| 1,515,073 | A | 11/1924 | Savard | |
| 1,595,516 | A * | 8/1926 | Happ | E03C 1/262 4/287 |
| 1,596,893 | A | 8/1926 | Schifter | |
| 1,612,588 | A | 12/1926 | Lacoste | |
| 1,770,639 | A | 7/1930 | West | |
| 1,903,366 | A | 4/1933 | Mercier et al. | |
| 1,996,279 | A * | 4/1935 | Dillon | E03C 1/264 4/279 |
| 2,038,852 | A | 4/1936 | Pasman | |
| 2,075,443 | A * | 3/1937 | Kirschner | E03C 1/262 251/100 |
| 2,285,833 | A | 1/1938 | Platt | |
| 2,337,331 | A | 12/1943 | Kirschner | |
| 3,075,203 | A * | 1/1963 | Stafford | E03C 1/244 4/286 |
| 3,982,289 | A * | 9/1976 | Robbins | E03C 1/264 4/292 |
| D246,109 | S | 10/1977 | Rosaen | |
| 4,409,692 | A | 10/1983 | Ness | |
| 4,932,082 | A | 6/1990 | Ridgeway | |
| 5,201,340 | A | 4/1993 | Teepe | |
| 5,442,819 | A | 8/1995 | Penor et al. | |

(Continued)

FOREIGN PATENT DOCUMENTS

| | | |
|---|---|---|
| CH | 228397 | 8/1943 |
| CN | 203498954 U | 3/2014 |

(Continued)

OTHER PUBLICATIONS

SU 1747617 Translation.*
JP 2010059701 Translation.*
JP 2006161419 Translation.*

*Primary Examiner* — Erin Deery
*Assistant Examiner* — William R Klotz

(57) ABSTRACT

A hair straining device for a drain is disclosed. The device has a central element, a bottom seal element, and a pair of arms.

22 Claims, 17 Drawing Sheets

(56) References Cited

U.S. PATENT DOCUMENTS

| | | | | |
|---|---|---|---|---|
| 5,915,847 | A * | 6/1999 | Spears | A47K 1/14 4/287 |
| 6,067,669 | A * | 5/2000 | Peterson | E03C 1/262 4/287 |
| 6,263,518 | B1 | 7/2001 | Magtanong | |
| 6,276,000 | B1 | 8/2001 | Saman | |
| 6,308,350 | B1 | 10/2001 | Marchionda | |
| 6,387,261 | B1 | 5/2002 | Mojena | |
| 6,558,538 | B2 | 5/2003 | Scuilla | |
| 6,938,279 | B1 | 9/2005 | Henderson | |
| 7,150,576 | B1 | 12/2006 | Kambeyanda | |
| 7,376,983 | B1 | 5/2008 | Sciarrino | |
| 7,704,386 | B2 | 4/2010 | Ventura | |
| 8,011,030 | B2 | 9/2011 | Li | |
| D650,471 | S | 12/2011 | Du | |
| 8,316,474 | B2 | 11/2012 | Kang | |
| D691,244 | S | 10/2013 | Ho | |
| D691,245 | S | 10/2013 | Ho | |
| 9,038,204 | B2 | 5/2015 | Walsh | |
| D746,417 | S | 12/2015 | Guterman | |
| D749,706 | S | 2/2016 | Johansen | |
| D753,791 | S | 4/2016 | Ruprecht | |
| D756,483 | S | 5/2016 | Ruprecht | |
| 9,371,636 | B2 | 6/2016 | Ali | |
| 9,518,383 | B2 | 12/2016 | Lesmeister | |
| 2002/0139731 | A1 | 10/2002 | Michels | |
| 2004/0073992 | A1 | 4/2004 | Saman | |
| 2009/0007321 | A1 | 1/2009 | Kang | |
| 2012/0047643 | A1 | 3/2012 | Meyers | |
| 2012/0060275 | A1 | 3/2012 | Cheng | |
| 2014/0007334 | A1 | 1/2014 | Golibart | |
| 2015/0259892 | A1 | 9/2015 | Gusterman | |
| 2015/0321127 | A1 | 11/2015 | Arent | |
| 2016/0130793 | A1 | 5/2016 | Lesmeister | |
| 2016/0251839 | A1 | 9/2016 | Ali | |

FOREIGN PATENT DOCUMENTS

| | | | |
|---|---|---|---|
| CN | 203583605 | U | 7/2014 |
| CN | 104790511 | A | 7/2015 |
| DE | 625068 | C | 2/1936 |
| DE | 20103271 | U1 | 6/2001 |
| EP | 1600566 | A1 | 11/2005 |
| EP | 2816161 | A1 | 12/2014 |
| GB | 2478146 | B | 8/2011 |
| JP | 2006161419 | A * | 6/2006 |
| JP | D1292683 | | 2/2007 |
| JP | 201059701 | A | 3/2010 |
| KR | 300524295.0000 | | 3/2009 |
| KR | 101679787 | B1 | 11/2016 |
| SU | 1747617 | A1 * | 7/1992 |
| WO | WO2006079141 | A1 | 8/2006 |

* cited by examiner

HAIR STRAINING DEVICE

FIELD OF THE INVENTION

The present invention relates to hair straining devices.

BACKGROUND

Drain pipes, particularly those that service shower stalls, bathtubs, or sinks are often clogged by an accumulation of hair that is shed by users. The hair flows down the drain with the water and accumulates in the drain pipe to form a clog that prevents proper drainage. Existing straining devices to catch this hair are typically provided above the drain pipe opening in the floor of the shower stall, bathtub, or sink in view of the user. Such devices are unsightly in that the accumulated hair is visible to the user at all times. These devices also have limited effectiveness and are difficult to clean. Accordingly, it would be desirable to provide a straining device that avoids these and other problems.

SUMMARY

A hair straining device for a drain is disclosed. In some embodiments, the device comprises a central element, a bottom seal element, and a pair of arms. The central element has a sidewall and a hollow core. The hollow core is interior of the sidewall. The sidewall has at least one sidewall opening in communication with the hollow core and extending through the sidewall.

The bottom seal element is connected to a bottom end of the central element. The bottom seal element extends radially outward from the central element. The bottom seal element has at least one bottom drain opening extending through the bottom seal element. The central element extends vertically from the bottom seal element.

The pair of arms extend laterally from the central element and are configured to at least partially support the central element relative to the drain. The at least one sidewall opening and the at least one bottom opening are sized and positioned to substantially prevent hair from flowing therethrough.

Numerous other advantages and features of the present invention will become readily apparent from the following detailed description of the invention and the embodiments thereof, from the claims, and from the accompanying drawings.

DETAILED DESCRIPTION OF THE EMBODIMENTS

Figure 1:
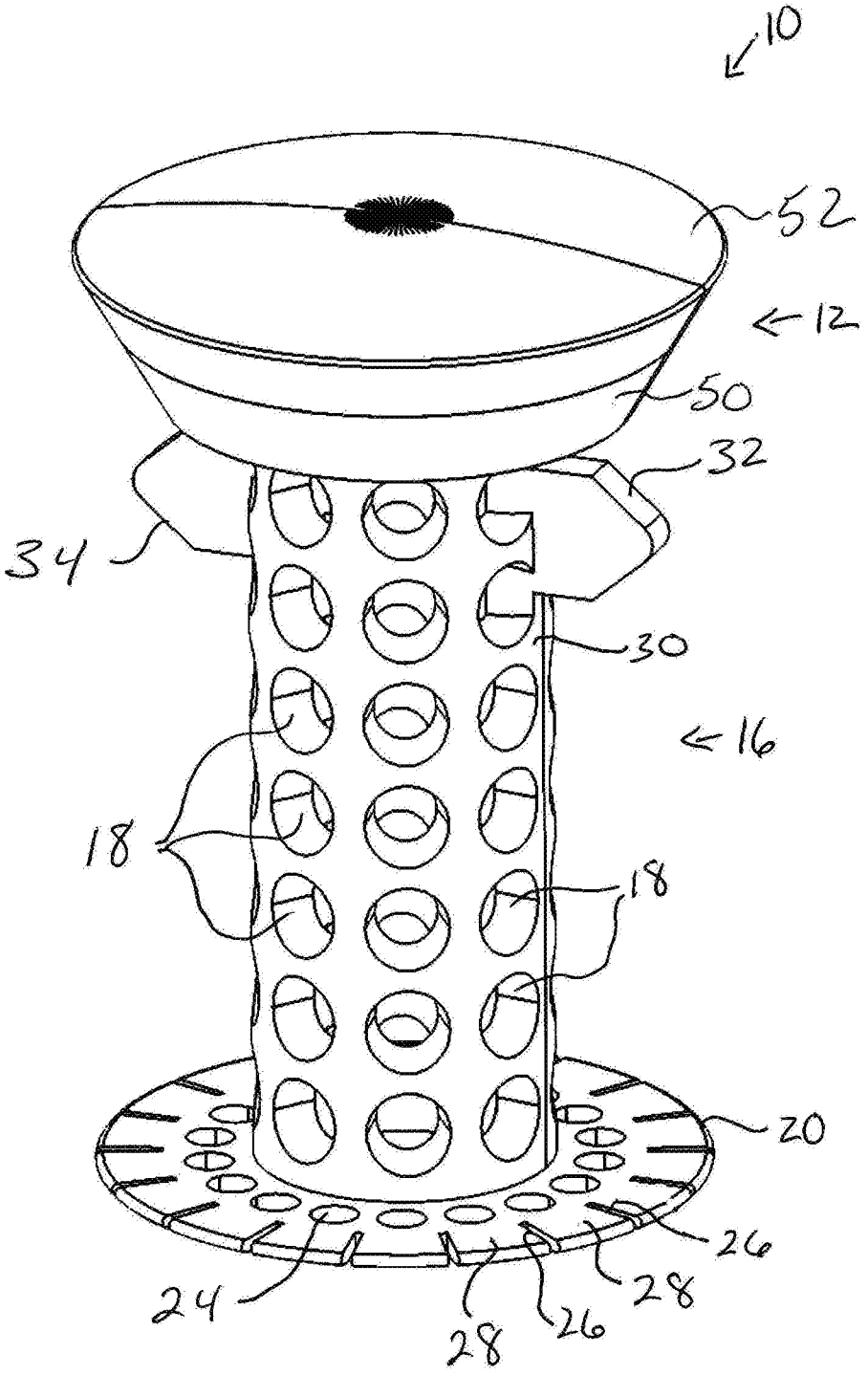
FIG. 1 is a front and top perspective view of a straining device in accordance with a first embodiment of the present disclosure.

The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 10:
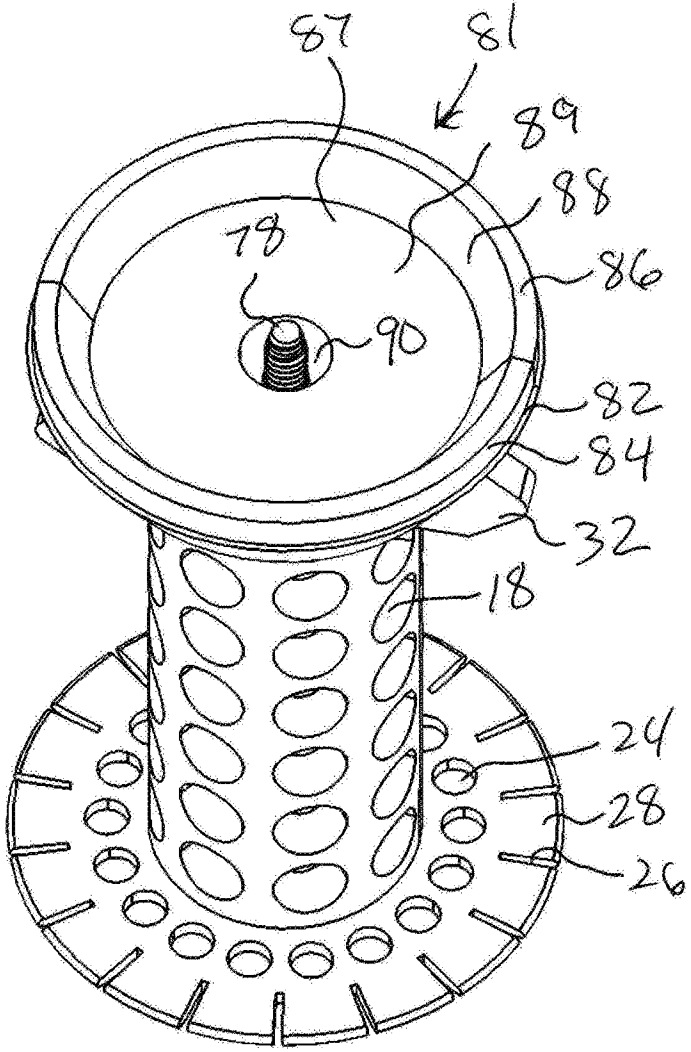
FIG. 10 is a top perspective view of the device of FIG. 1 with the cap removed.

A perspective view of a straining device 10 in accordance with an embodiment of the present disclosure is illustrated in FIGS. 1 and 10. The straining device 10 comprises a top seal element 12 mounted on a top of a central element, or central body, 16 with a bottom seal element 20 provided on the bottom end of the central element 16. The central element 16 is illustrated as having a cylindrical shape, however, the central element 16 is not limited to a cylindrical shape. For example, in some embodiments, the central element could be multisided, such in an octagonal or other shape.

The central element 16 includes a hollow central core 17 through which water may pass, whether cylindrical in shape or any other desired shape. A plurality of center drain openings 18 are formed in the sidewall 30 of the central element 16 to allow water to pass there through and into the central hollow core 17. While a plurality of drain openings 18 are shown in the drawings, in some embodiments, the central element 16 need only include a single drain opening.

Figure 4:
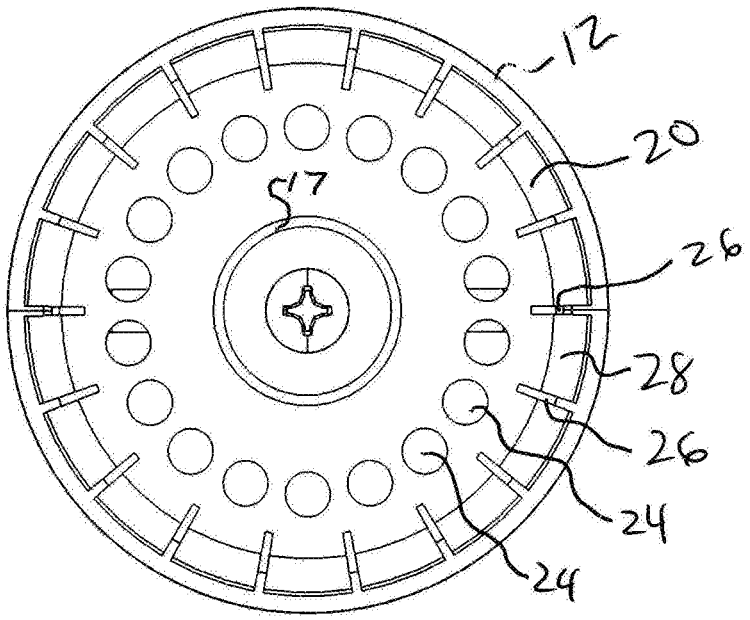
FIG. 4 is a bottom view of the device of FIG. 1.

The bottom seal element 20 preferably extends radially outward from the central body 16 a predetermined distance and comprises a plurality of bottom drain openings 24 formed therein. While in the drawings a plurality of bottom drain openings 24 are provided, in other embodiments, fewer or even a single bottom drain opening may be used, if desired. The bottom drain openings 24 allow the flow of water there through, but are sized and positioned to prevent hair from passing there through. In some embodiments, the diameter of the bottom seal element 20 is preferably less than that of the top seal element 12 and larger than that of the central body 16 as is shown in FIGS. 1 and 4. In some embodiments, the bottom seal comprises substantially a ring shape, with an open enter thereof aligned with the core 17 of the central element 16. The bottom seal 20 may be integrally formed with the central element 16 or may be attached thereto.

The perimeter of the bottom seal element 20 comprises a plurality of slots 26. In some embodiments, the slots are spaced apart equidistantly about the bottom seal element. The slots 26 break up the perimeter of the seal element into a plurality of flaps 28. In some embodiments, the flaps are equally sized and spaced. In some embodiments, the flaps are not equally sized or equally spaced. The flaps comprise sufficient rigidity to retain their shape when not underload. The flaps are sufficiently flexible to at least partially bend upward or downward in respond to contact with a drain pipe wall. In some embodiments, the slots 26 penetrate radially inward but stop before meeting the openings 24.

When the top seal element 12 is not engaged with the perimeter of a drain, water will flow between the top seal element and the drain perimeter. Water may pass through drain openings 18 and into the central hollow core 17 of the central element 16. The water may also flow through the bottom drain openings 24 and or slots 26 in the bottom seal element. Each of the openings 18, 24, and slots 26 are sized and positioned to impede the passage of hair there through into the drain below. In some embodiments, the openings 18, 24, and slots 26 are sized and positioned to impede the passage of long hair there through into the drain below.

Figure 3:
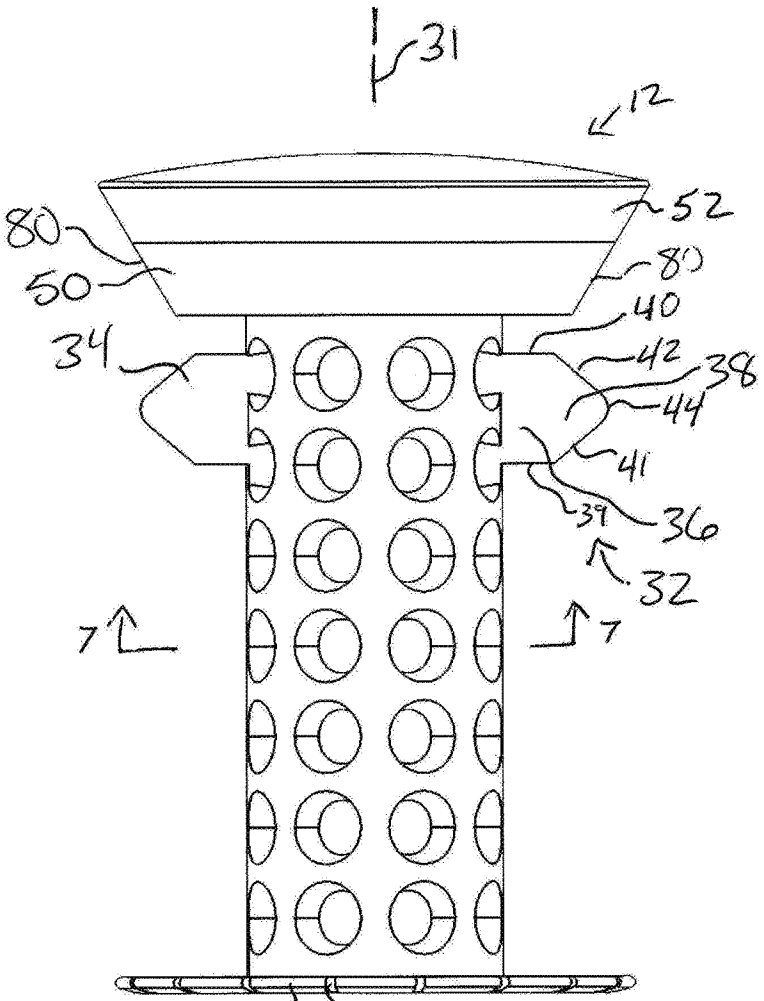
FIG. 3 is a front view of the device of FIG. 1.
Figure 2:
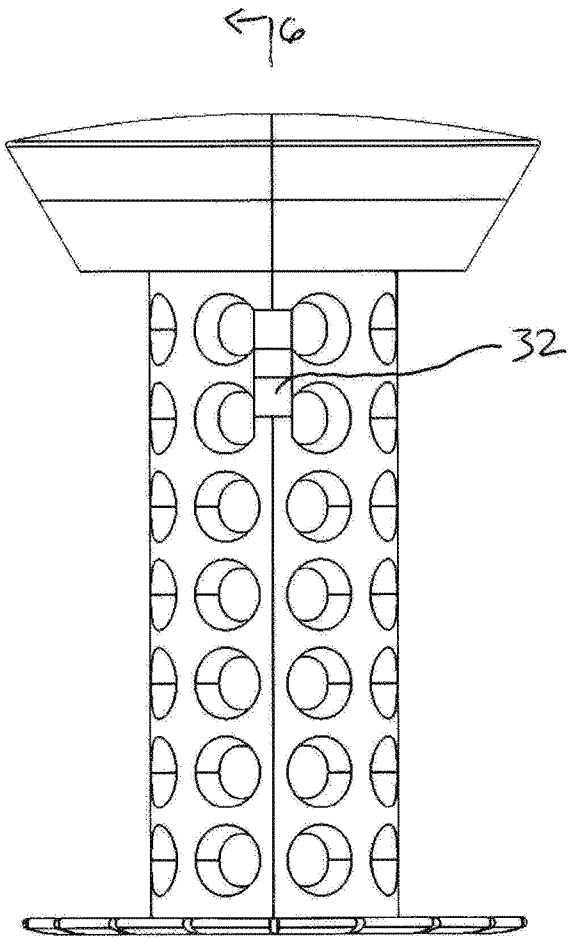
FIG. 2 is a right side view of the device of FIG. 1.

As shown in FIG. 3, the center element 16 comprises arms 32, 34. The arms 32, 34 extend from opposite sides of the sidewall 30 as shown in FIG. 3. The arms are mirror image identical about the midplane 31 so only arm 32 will be described in detail. The arm 32 has a post portion 36 and an arrowhead portion 38. The post portion 36 has a lower surface 39 and an upper surface 40. The arrowhead portion 38 comprises converging walls 41, 42 and a tip 44 at the convergence of the converging walls. In some embodiments, the tip is curved, arched, or circular. In some embodiments and applications, the arms can be configured to extend a length from the central element 16 sufficient to contact the sidewalls of a drain pipe and to stabilize the device relative thereto.

Figure 6:
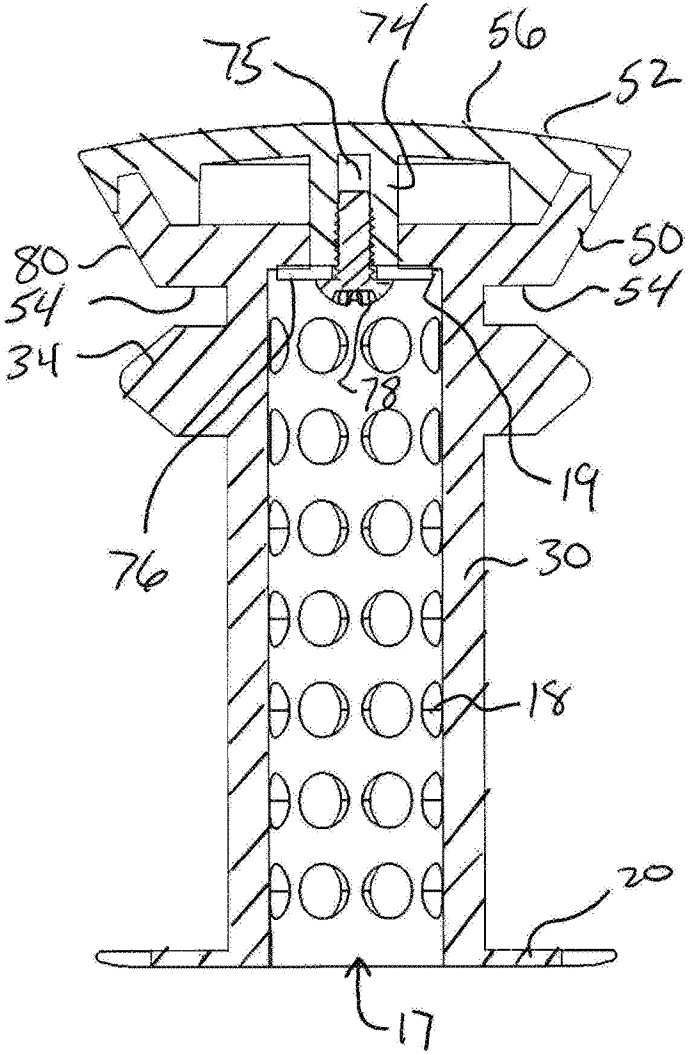
FIG. 6 is a front section view taken along line 6-6 of FIG. 2.

The top seal element 12 comprises a base 50 and a cap 52. The base 50 is attached to the central element 16. The cap is removably attachable to the base. The base 50 comprises a bottom wall 54, a side wall 80, and an upper area 81. The cap is received on the upper area. The upper area comprises a bottom ledge 82 and a lip 86. The lip 86 comprises an outside wall 84 and an inside wall 88. The outside and inside walls 84, 88 are converging towards a plateaued top surface of the lip 86. The inside wall 88 joins to a bottom surface 89. The inside wall 88 and the bottom surface 89 form a recessed area 87. The bottom surface 89 may be a flat surface. The bottom surface 89 comprises an opening 90 through which a shaft of a fastener, such as a screw 78, may be received. The opening 90 is sized to receive a post 74 of the cap as shown in FIG. 6. The post 74 may be a cylinder or other shape. The base 50 may be integrally formed with the central element 16 or may be attached thereto.

Figure 5:
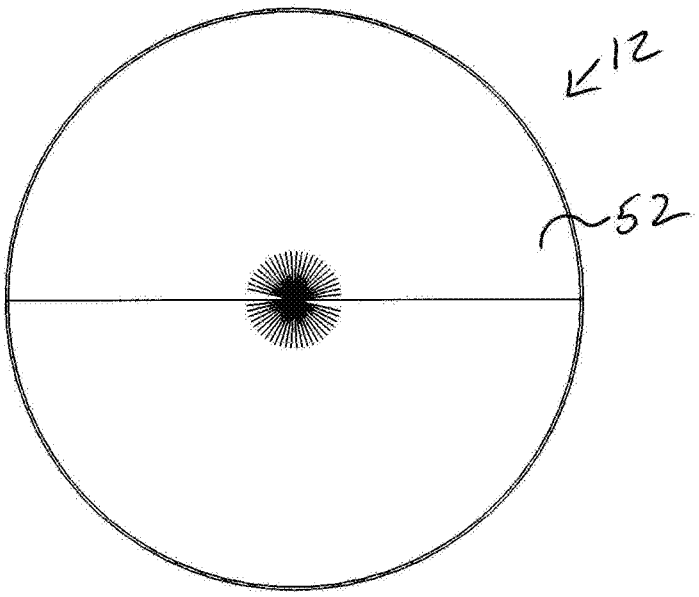
FIG. 5 is a top view of the device of FIG. 1.
Figure 7:
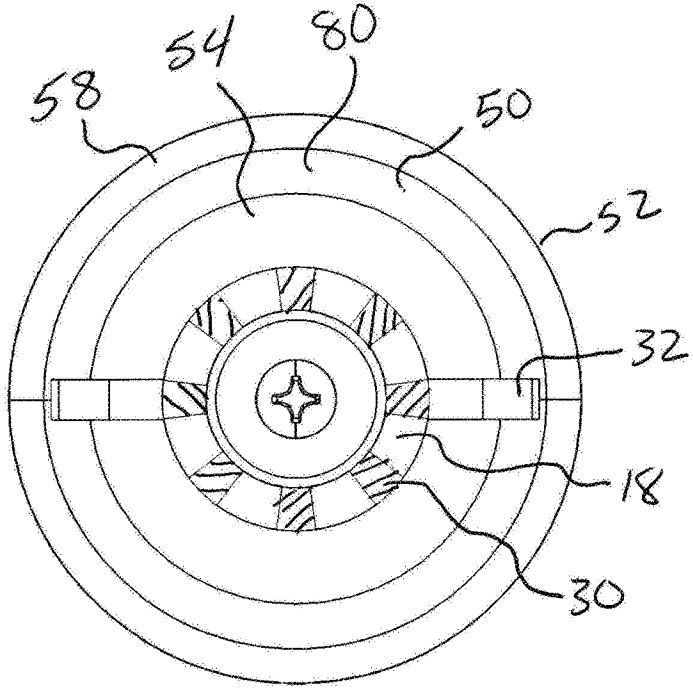
FIG. 7 is a bottom section view taken along line 7-7 of FIG. 3.
Figure 8:
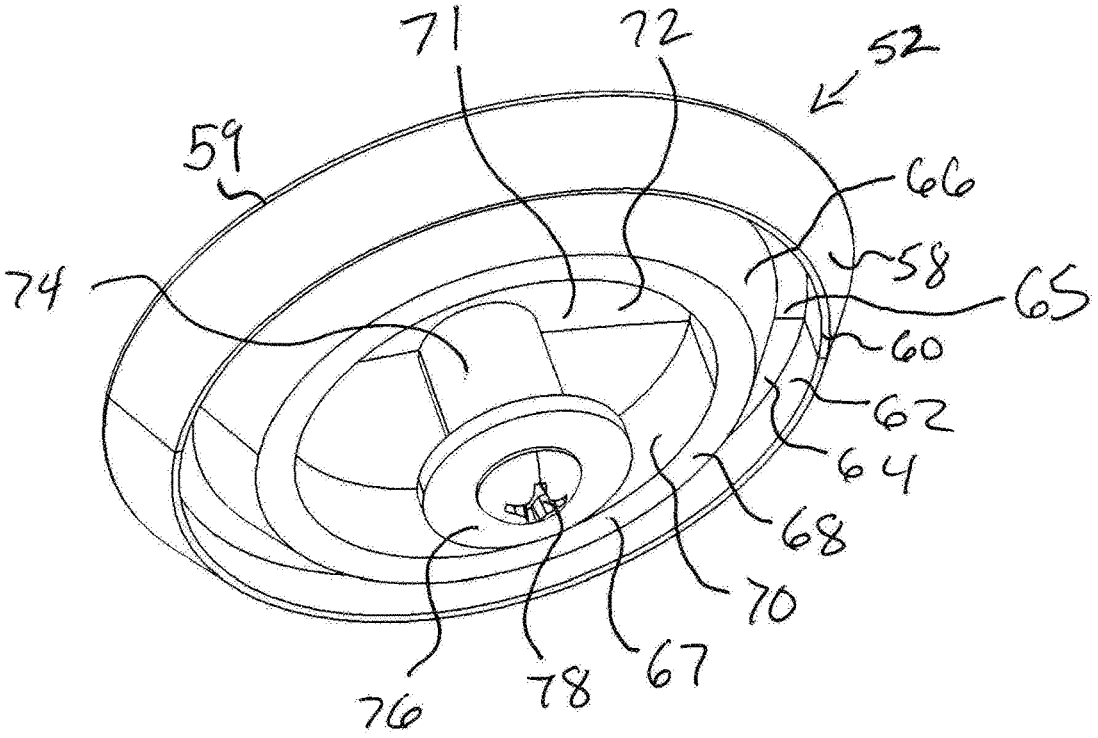
FIG. 8 is a bottom perspective view of a cap of the device of FIG. 1.
Figure 9:
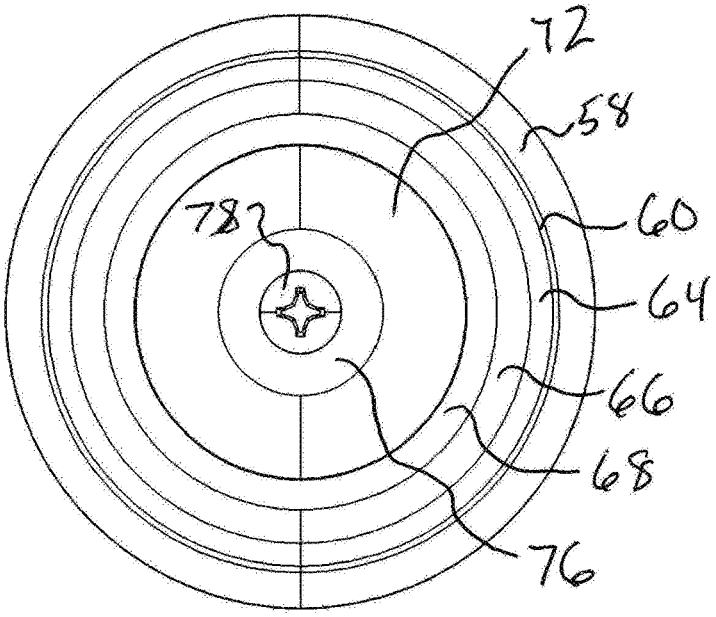
FIG. 9 is a bottom view of the cap of FIG. 8.

As shown in FIGS. 5, 8, and 9, the cap 52 comprises a top surface 56. The top surface may be curved, domed, flat, or another shape. The cap further comprises an outside wall 58 that joins with the top surface 56 at an edge 59. The outside wall 58 converges as it extends downward to a bottom lip 60. In some embodiments, the outside wall 58 comprises a conical shape or a partially conical shape. In some embodiments, the outside wall 58 has a concave shape. A first inside wall 62 joins with the outside wall 58 at the lip 60. The first inside wall 62 joins with the first surface 64 at an end opposite the lip 60. Opposite the first inside wall 62 is a second inside wall 66. The walls and surface 62, 64, 66 comprise a first outside groove 65. The second inside wall 66 is angled towards a ring surface 68. Opposite the second inside wall 66 is a third inside wall 70. The walls and surfaces 66, 68, 70 form a first ring 67. The third inside wall 70 forms an inner area 71 with an inner floor 72. In the inner area 71 comprises a post 74. The post 74 extends from the inner floor 72. The post 74 has a hallow base core 75. The base core 75 may comprise sidewalls having thread grooves for receiving threads of a fastener shaft.

As is shown in FIG. 6, in some embodiments, when the cap 52 is placed on the base 50 the following occurs. The lip 60 will be placed against the ledge 82. The lip 86 will be received in the groove 65. The first ring 67 will be received in the recessed area 87. The wall 66 is in surface to surface contact with the wall 88. The post 74 will be received in the opening 90. The cap may be secured to the base by inserting a fastener 78 in the core 17 and threading the fastener 78 into the base core 75 of the post 74. A washer 76 may be provided between a head of the fastener 78 and an interior upper wall 19 of the hollow core 17. In some embodiments a washer is not used and the head of the fastener is large enough to engage the wall 19. Therefore the cap is secured to the central element 16 by the fastener 78 engaging a portion of the walls of the hollow core 17 and by the shaft of the fastener 78 engaging with the base core 75 of the post 74, as is shown in FIG. 6. The cap can be released from the base by removing the fastener and withdrawing the cap from the base.

In some embodiments, in some embodiments, the device 10 has the following dimensions. The top seal element has a diameter of about 18.5 mm. The sidewall 30 of the central element has a thickness of about 6.35 mm. The central element has a height of about 49.5 mm. The central element has a width or diameter of about 18.5 mm. The bottom seal element has a width or diameter of about 37.6 mm. The top element has a width or diameter of about 39 mm. The width of the base 50 at the intersection of the bottom wall 54 and sidewall 80 is about 28.5 mm. The width of from the outer end of one arm to the outer end of the other arm is about 33.9 mm. The height of the arm is about 6.6 mm. The openings 18 have a diameter of about 5.33 mm or between about 3.3 mm and about 7.4 mm, inclusive. The opening 24 have a diameter of about 3 mm or between about 3 mm and about 5 mm, inclusive. The height of the device is about 64.8 mm. These are only exemplary dimensions and it will be recognized that the device can be made in various dimensions depending on application, preference, and other factors. The size of the openings 18, 24 may vary provided that the opening substantially prevents hair from passing there through.

Figure 11:
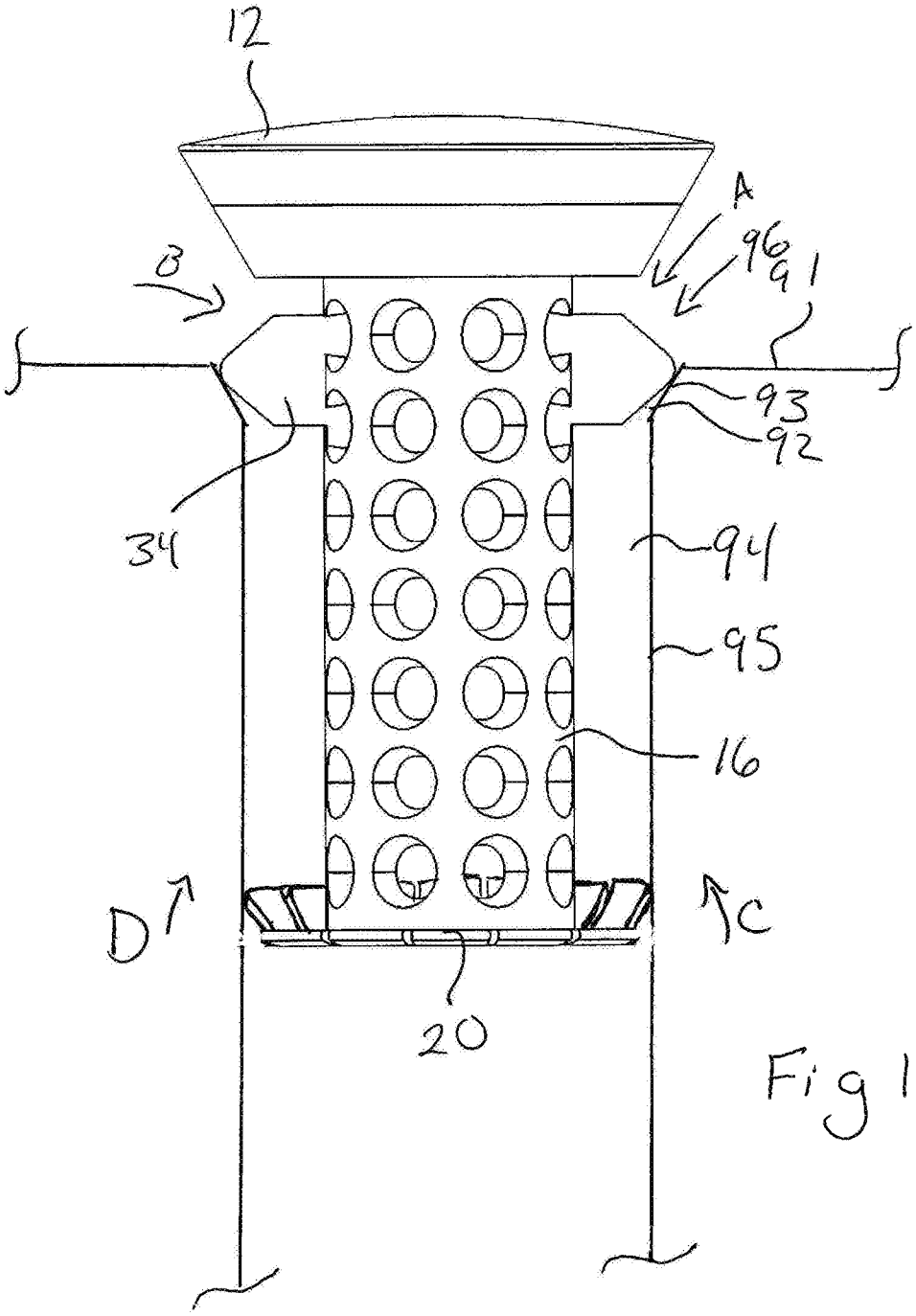
FIG. 11 is a front view of the device of FIG. 1 deployed in a drain pipe, the drainpipe shown in section view.
Figure 12:
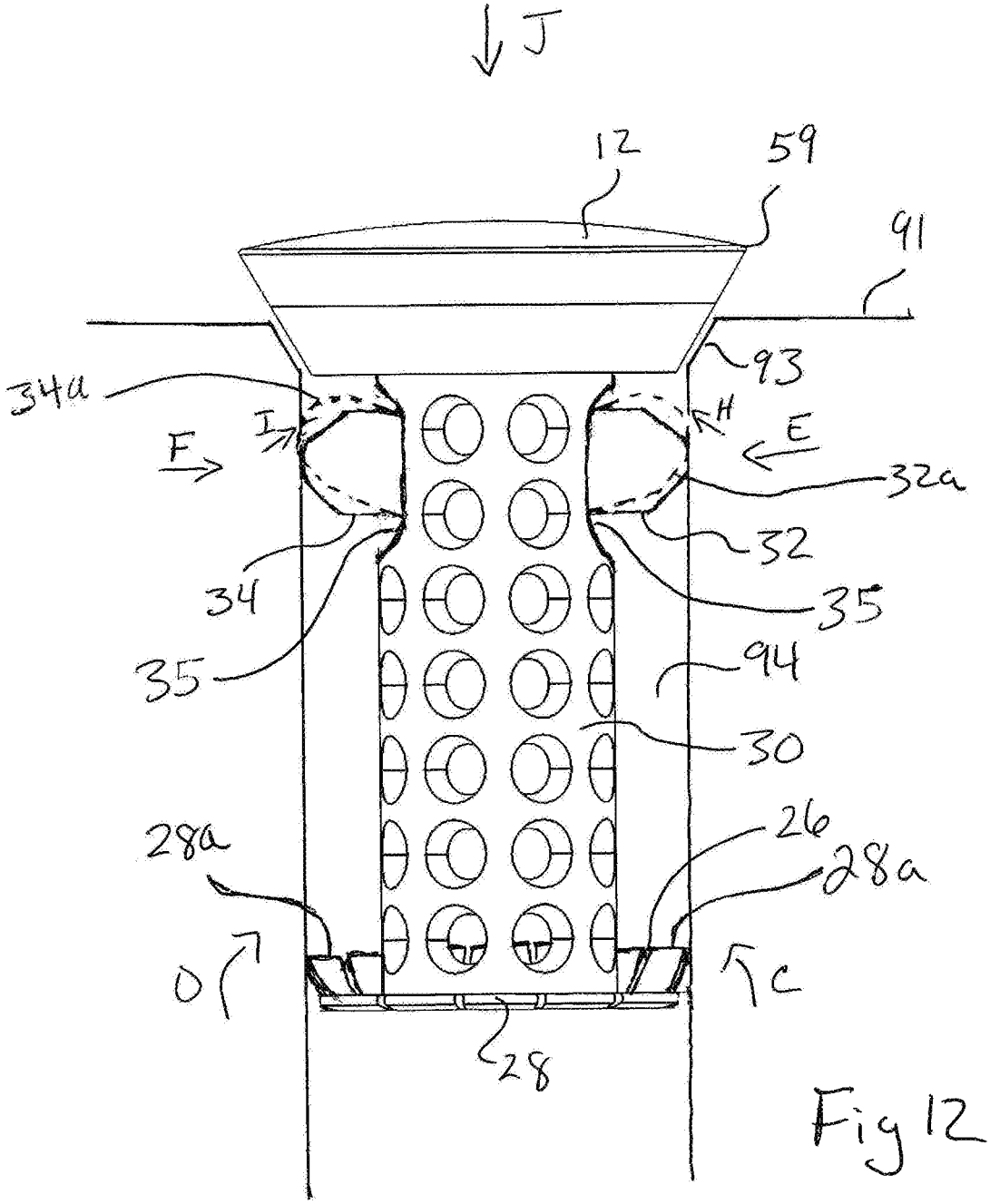
FIG. 12 is a front view of the device of FIG. 11, shown in a closed deployed position.
Figure 13:
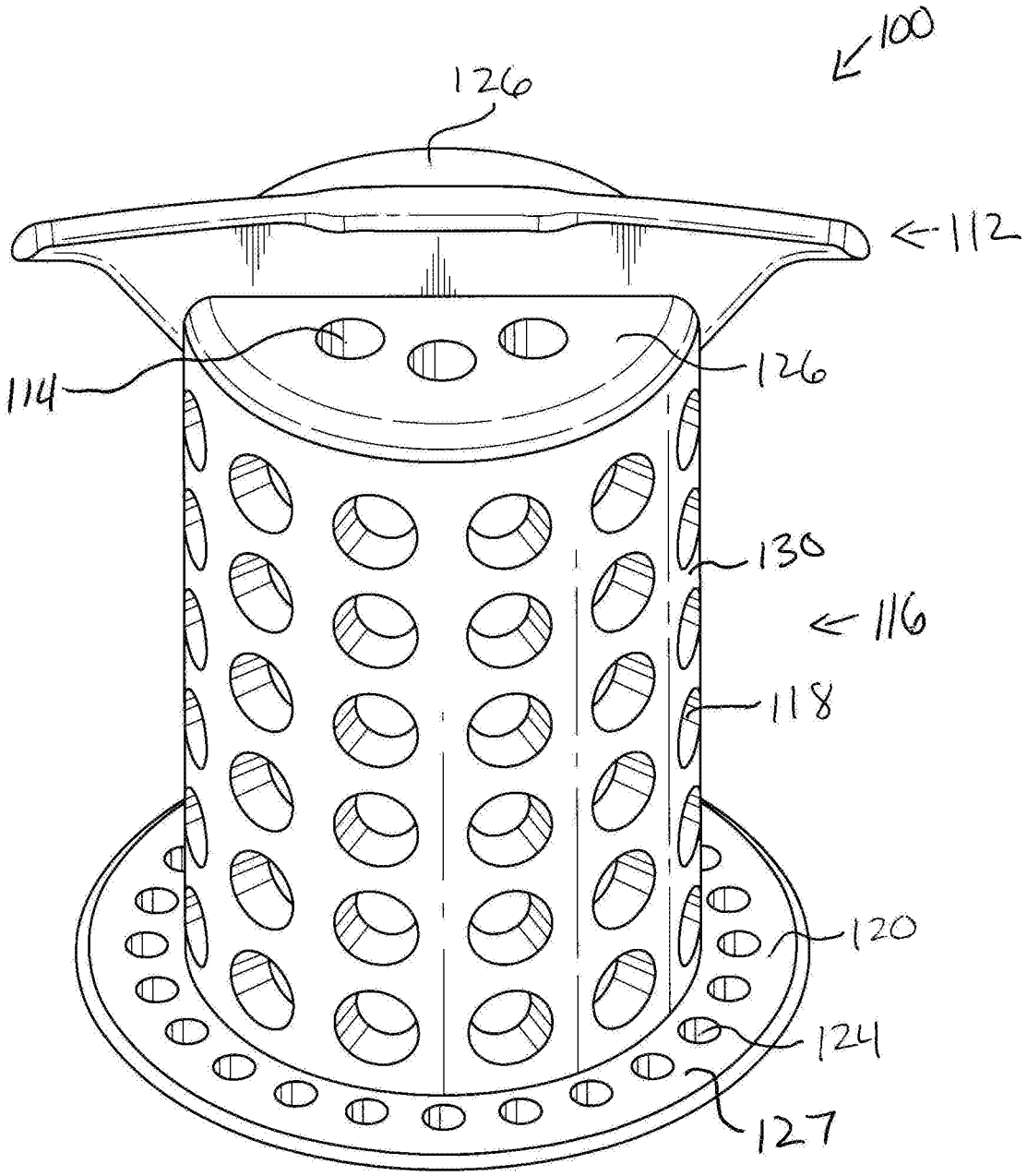
FIG. 13 is a front and top perspective view of a straining device in accordance with a second embodiment of the present disclosure.

FIGS. 11 and 12 show the device 10 in different stages of deployment in a drain 96. In some applications, the drain 96 is a sink drain, such as a bathroom sink drain. While the device 10 is shown in an exemplary sink drain, the device can be used in other drain pipes. Certain applications may have standard diameter drain pipes. The device may be sized to fit such standard diameter pipe or other non-standard or custom pipe sizes. The bottom seal 20 may be have the same diameter as the inside diameter of the drain pipe where the device is to be deployed. In some applications, the bottom seal 20 may be have a slightly larger diameter than the inside diameter of the drain pipe where the device is to be deployed. As a seal is formed between the bottom seal 20 and the drain pipe, water can only drain through the drain pipe by passing through openings 18, 24, and slots 26, which are sized to prevent hair from passing there through.

In some applications, the drain 96 is located in an opening of the sink floor 91. The drain may comprise a first portion 92 that is wider than the diameter of the drain pipe 94. The first portion 92 may comprise angled sidewall(s) 93 connecting a wider sink floor opening to a narrower drain pipe. In some applications, the drain pipe 94 connects directly to the sink opening without the use of a first portion 92.

In some embodiments and applications, the arms extend beyond the width of the drain pipe 94 as shown in FIG. 11. Therefore the device may be placed in the drain and supported by the arms contacting the walls 93, edge or floor of the sink, or edge of the drain pipe. In FIG. 11, the arms are supporting the device 10 in contact with the sidewall 93 of the first portion 92. In the deployed open position of FIG. 11, the device allows water to flow in the directions A and B about and around the element 12 and down into the drain 96. The seal element 12 does not close the drain opening when in the deployed open position.

Downward pressure applied in the direction J of FIG. 12 on the device when placing it into the drain causes the element 20, or a peripheral end thereof, to bend upwards in the direction C and D and to extend along a portion of the drain wall to form a seal therewith. The drain pipe 94 is shown in section view with the front half of the drain pipe not shown. Therefore, the rear flaps 28, labeled as 28*a* in FIG. 12, are as shown in a bent upward or raised position. But the front flaps in FIG. 12 are not shown in a raised position because of the section cutout view of the drain pipe. It will be recognized that all of the flaps 28 will be in a raised position when pressed downward in the drain pipe although this is not shown in FIG. 12. The seal will prevent water from passing the seal element 20 at the perimeter where the seal meets the sidewall, except at the slots 26. In some applications and embodiments, the element 12 and the flaps 28 will only slightly be raised, and less than is shown in FIG. 12, in the directions C and D.

The device is shown in a deployed closed positioned in FIG. 12. The element 12 is seated in the first portion and forms a water tight or substantially water tight seal to prevent water from passing into the drain. Downward pressure applied in the direction J by a user to move the device to the deployed closed position causes the arms to compress inward in the directions E and F of FIG. 12. This also causes the arms to bend upward in the directions H and I. In some applications or embodiments, the upward bend may be slight. In some application or embodiments, the arms may bend more than in others, for example, arms may bend to the position 32*a*, 34*a* of FIG. 12. In other applications or embodiments, the arms may bend less, such as shown at 32, 34 of FIG. 12. Further, in some embodiments and applications, the sidewall 30 at and adjacent to the arms will deform 35 inward to allow the arms to fit within the drain pipe 94. In some embodiments, at least a portion of the top seal element 12 will extend above the sink floor 91 or drain opening so it can be grasped by a user to withdrawal or remove the device from the deployed closed position, as shown in FIG. 12. In some embodiments, the edge 59 is above the sink floor or drawin opening for grasping. In some embodiments, the wall 58 of the cap and or the wall 80 of the base extend above the floor 91 and may also, or in the alternative, be grasped by the user to withdraw the device.

In some embodiments the cap may be made of or comprise a different material from that of the remaining portion of the device 10. In some embodiments the cap will comprise a metal or metallic surface to match the metal or metallic plate about the opening to the drain, for example in a sink.

FIGS. 13 through 19 show a second embodiment hair straining device 100. The straining device 100 comprises a top support element 112 mounted on a top of a central element, or central body, 116 with a bottom seal element 120 provided on the bottom end of the central element 116. The central element 116 is illustrated as having a cylindrical shape, however, the central element 116 is not limited to a cylindrical shape.

The central element 116 includes a hollow central core 117 through which water may pass, whether cylindrical in shape or any other desired shape. A plurality of center drain openings 118 are formed in the sidewall 130 of the central element 116 to allow water to pass there through and into the hollow central core 117. While a plurality of drain openings 118 are shown in the drawings, the central element 116 need only include a single drain opening. The central element comprises a top surface 126. In some embodiments, the top surface comprises top one or more drain openings 114.

Figure 14:
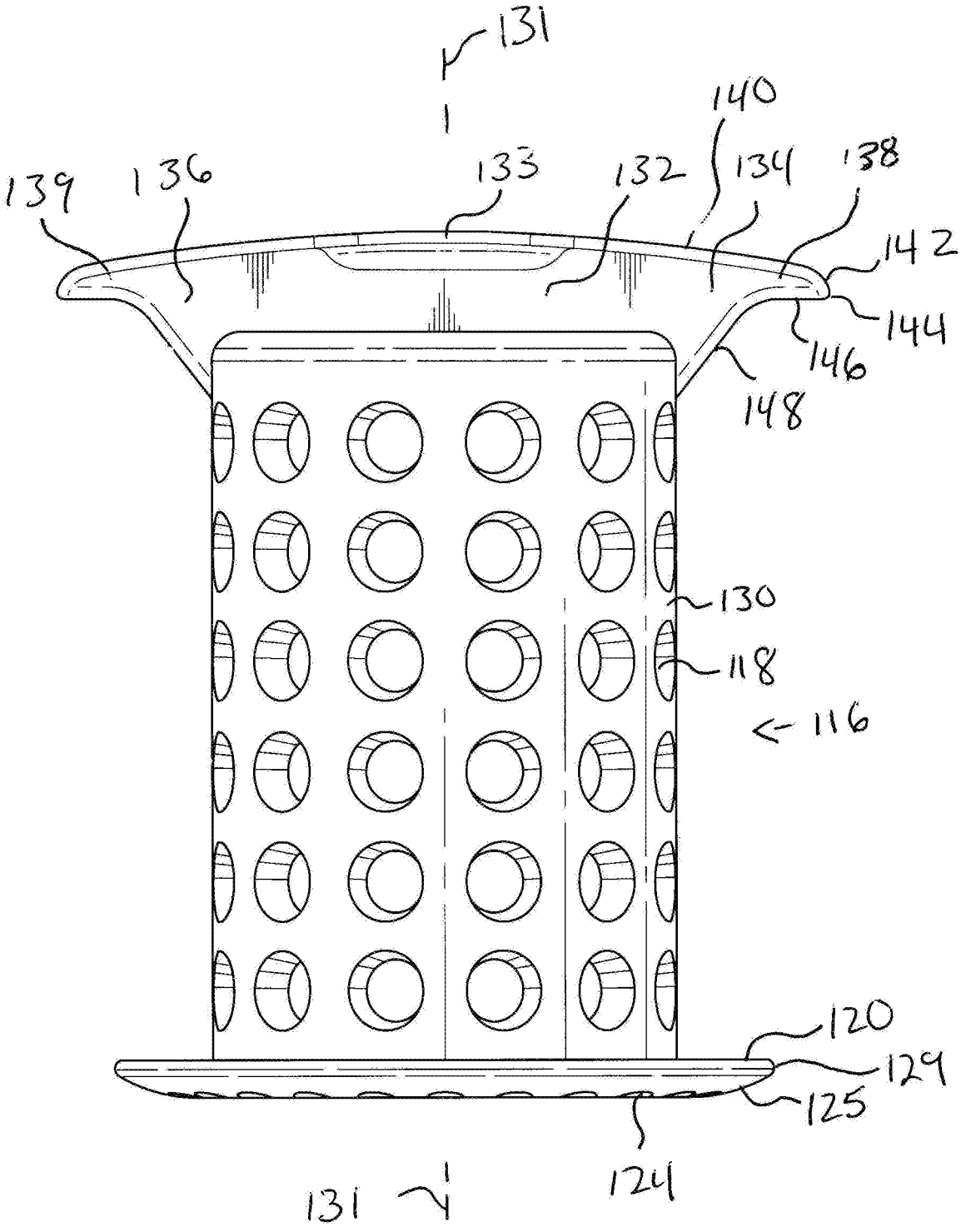
FIG. 14 is a front view of the device of FIG. 13.
Figure 15:
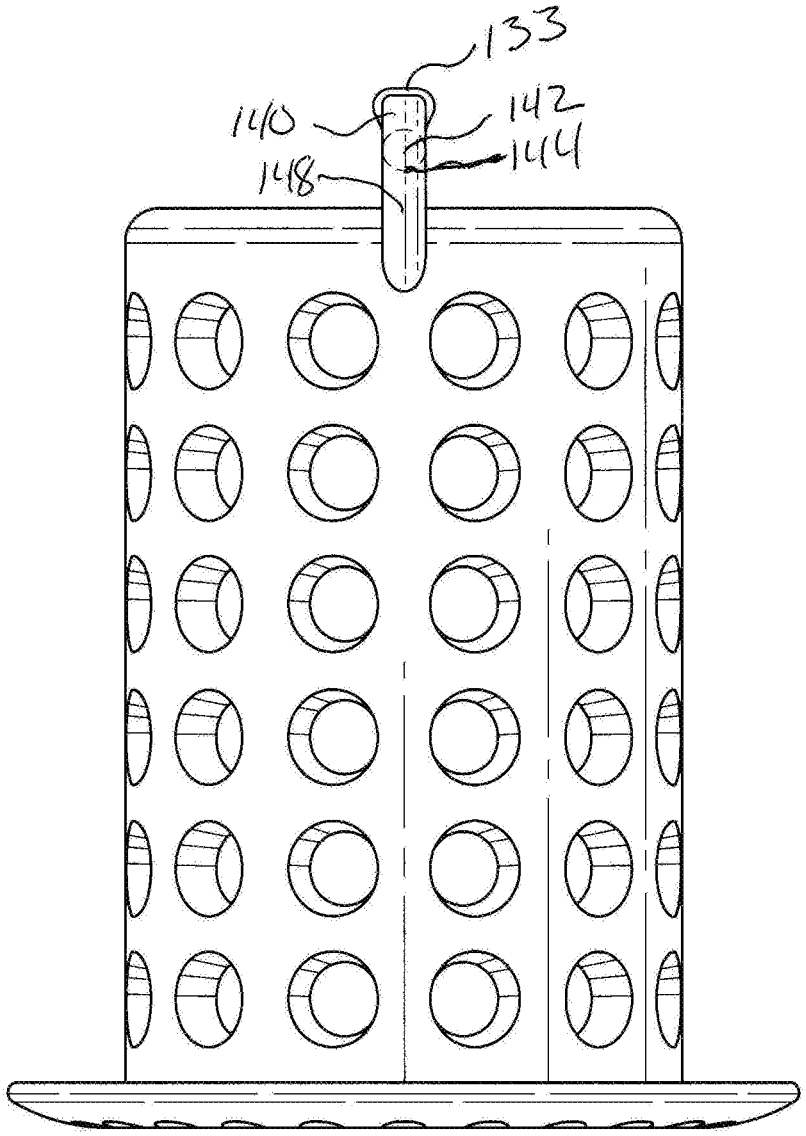
FIG. 15 is a right side view of the device of FIG. 13.
Figure 16:
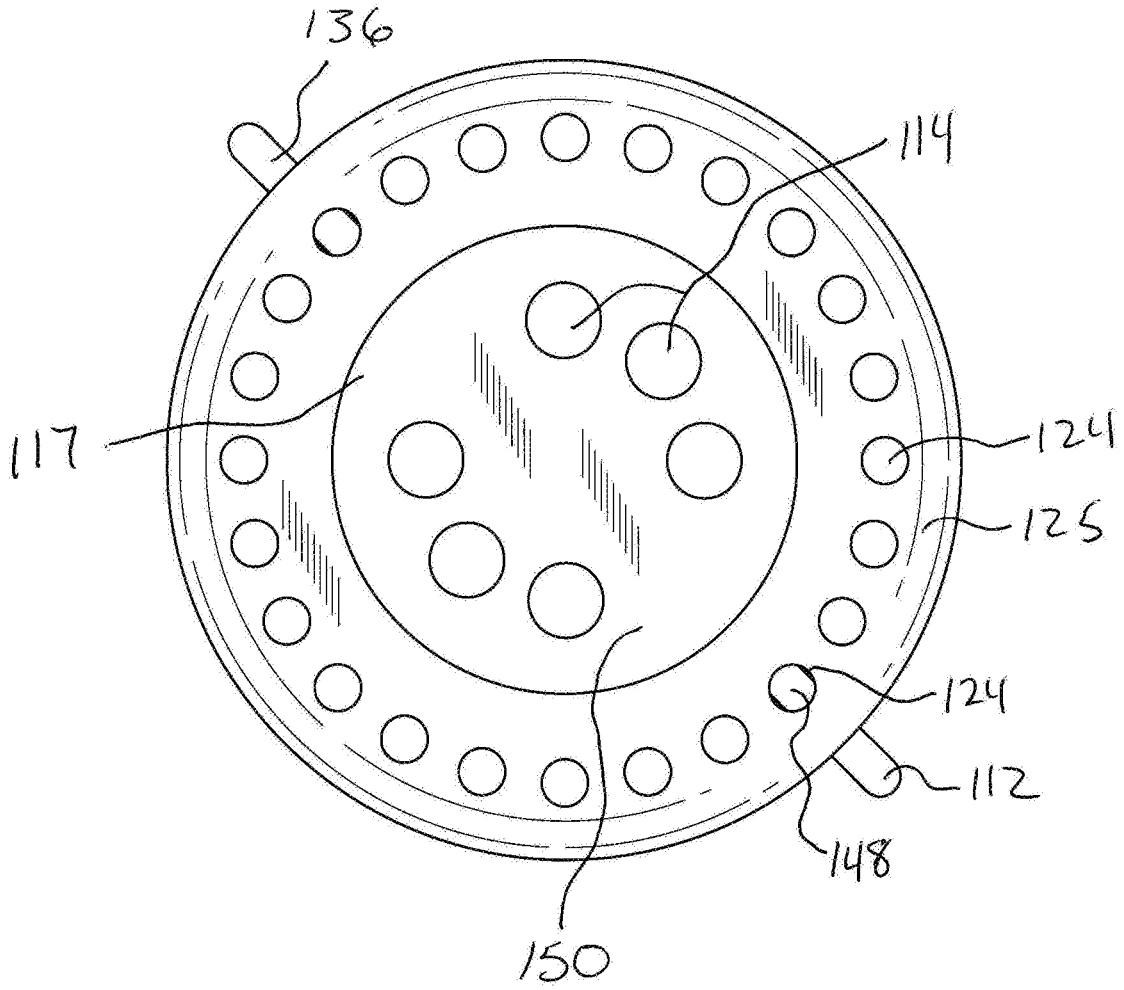
FIG. 16 is a bottom view of the device of FIG. 13.
Figure 17:
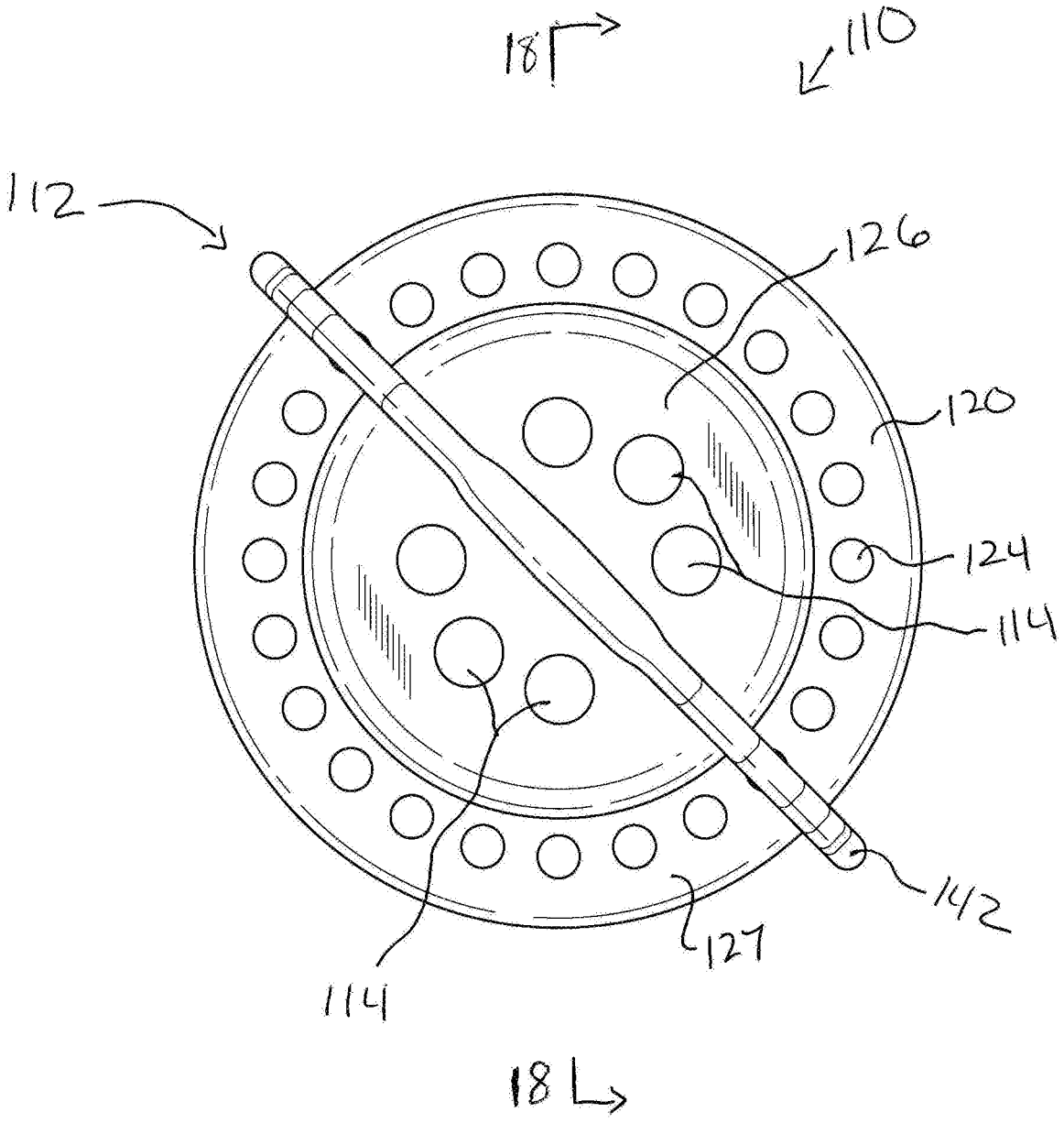
FIG. 17 is a top view of the device of FIG. 13.
Figure 18:
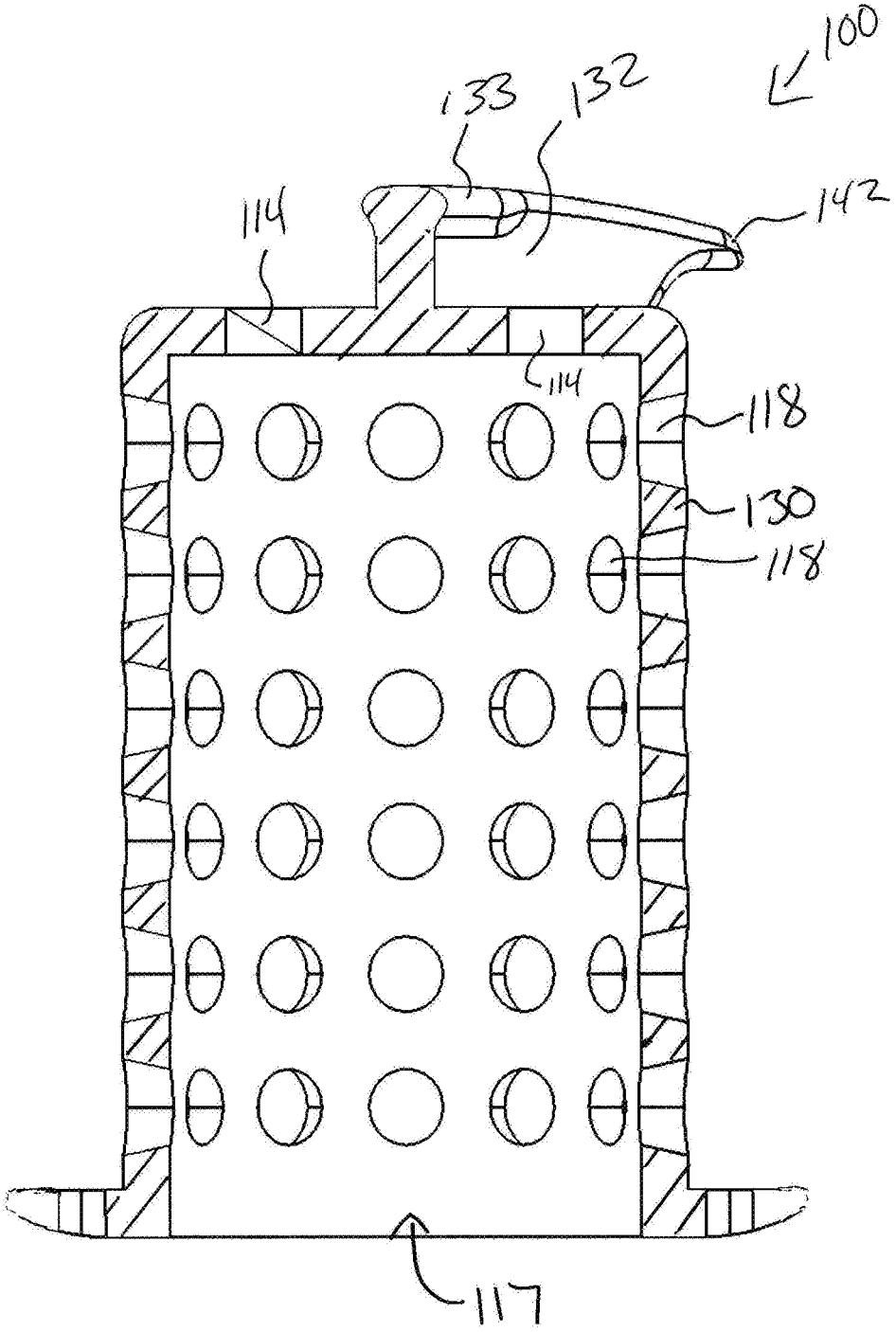
FIG. 18 is a front section view taken along lines 18-18 of FIG. 17.

The bottom seal element 120 preferably extends radially outward from the central body 116 a predetermined distance and comprises a plurality of bottom drain openings 124 formed therein. While in the drawings a plurality of bottom drain openings 124 are provided, in some embodiments, fewer or even a single bottom drain opening may be used, if desired. The bottom drain openings 124 allow the flow of water there through, but are sized and positioned to prevent hair from passing there through. In some embodiments, the width of the bottom seal element 120 is preferably less than a width of a top support element 112 and larger than that of the central body 116 as is shown in FIGS. 14 and 16. In some embodiments, the bottom surface 125 of bottom seal element 120 has a curved shape as shown in FIGS. 14 and 15. In some embodiments, the top surface 127 of bottom seal element 120 comprises a flat surface. The top and bottom surfaces 127, 125 meet at an edge 129.

The top support element 112 is for engaging the perimeter of a drain. Water will follow between the around element 112. Water may flow through drain openings 114 and or 118 to allow water to pass into the hollow central core 117 of the central element 116, and further down into the drain. The water may also flow through the bottom drain openings 124 in the bottom seal element and further down into the drain. Each of the openings 114, 118, and 124 are sized and positioned to impede the passage of hair, such as long hair, there through into the drain below. In some embodiments, the openings 118 and 114 comprise a larger opening then openings 124. In some embodiments, all the openings are the same size. While the openings are shown as circular apertures in the figures, it will be understood that other shaped apertures could be used.

The top element 112 comprises a main body 132, first arm 134 and a second arm 136. The element 112 is mirror image identical about a midline 131 of FIG. 14. Therefore, only the first arm 134 will be described in detail. The first arm 134 comprises a first upper downward sloping surface 140 a second downward sloping surface 142, a first lower up word angled surface 148, and a second lower surface 146. The second lower surface 146 joins with the second upper downward sloping surface 142 at point 144. In some embodiments, point 144 is rounded. The arms 134 extend outwardly beyond the side wall 130 of the central element 116. An arm end portion 138 comprises the second lower surface 146. The second lower surface 146 is configured to engage with a corresponding ledge or contact component of a drain. At the center of top element is a handle portion 133 that is slightly wider than a width of the main body 132 as shown in FIG. 15. The slightly wider width enables an easier gripping area for a user. The user may grab the handle portion 133 to place the device 100 in a drain or to remove it from the drain.

Figure 19:
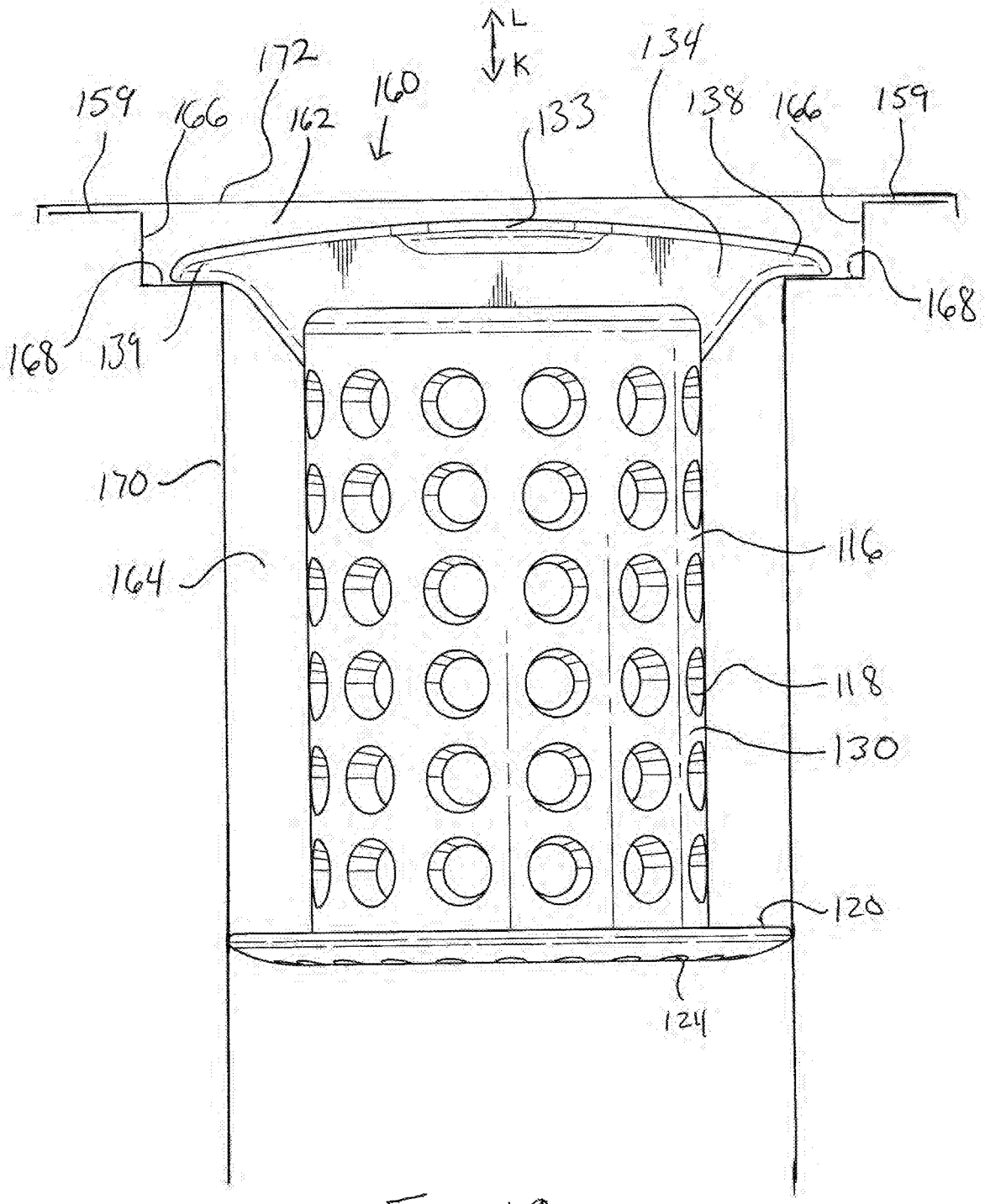
FIG. 19 is a front view of the device of FIG. 13 deployed in a train, wherein the drain is shown in section view.

FIG. 19 shows the device 100 deployed in a drain 160, such as a shower drain. The exemplary drain 160 comprises a first portion 162 and a drain pipe 164. The first portion 162 is wider than the diameter of the drain pipe 164. The first portion connects with the surrounding area, such as a shower floor 159. The first portion has a first ledge 168 that may be perpendicular to the side wall 166 of the first portion 162. The drain pipe side wall 170 of the drain pipe 164 connects with the first ledge 168. A user may grasp the device 100 by the handle 133 and lower or push it downward into the drain in the direction K of FIG. 19 until the arm and portions 138, 139 are resting on the ledge 168. The arms contacting the ledge prevent the device 100 from proceeding further down the drain pipe. The bottom seal element 120 contacts the side wall 170 of the drain pipe 164 to form a watertight or substantially watertight seal therewith.

In some embodiments or some applications, the bottom seal element 120 or an edge thereof may bend upwards when downward force is applied to the device 100 in a drain pipe. The friction between the element 120 and the side wall 170 of the drain pipe will cause the seal element 122 to at least partially extend upwards.

The drain may comprise a grate or drain cover 172. The support element 112 may comprise a low profile shape so that it will fit below the drain cover 172 and below the shower floor 159. The device 100 can be removed from the drain by removing any cover such as 172 and withdrawing the device by grabbing the handle 133 or another portion and moving it upward in the direction L of FIG. 19.

When the device 100 is deployed in the position shown in FIG. 19 water will flow through the device and the openings 114, 118, 124 will allow the water to pass therethrough but will substantially stop any hair from passing through those openings. Water may passed directly into the top openings 114, water may flow over the side wall 130 and through the openings 118 in the sidewall or the water may flow to the bottom seal element 120 and through the openings 124 in the bottom seal element.

In the event that a water level exceeds the height of the top surface 126 of the central element 116, the top openings 114 are sized and positioned to prevent the passage of hair therethrough, while allowing water to pass.

In some embodiments, the device 100 has the following dimensions. The top support element 112 has a width of about 63.5 mm. The sidewall 30 of the central element has a thickness of about 6.25 mm. The central element has a height of about 62.2 mm. The central element has a width or diameter of about 38.1 mm. The bottom seal element has a width or diameter of about 54.1 mm. The openings 118 have a diameter of about 6.48 mm or between about 3.5 mm and about 9.5 mm, inclusive. The openings 114 have a diameter of about 5.08 mm or between about 3.5 mm and about 9.5 mm, inclusive. The openings 124 have a diameter of about 3.2 mm or between about 3 mm and about 5 mm, inclusive. The device has a height of about 70.4 mm. These are only exemplary dimensions and it will be recognized that the device can be made in various dimensions depending on application, preference, and other factors. The size of the openings 114, 118, 124 may vary provided that the opening substantially prevents hair from passing there through.

Figure 20:
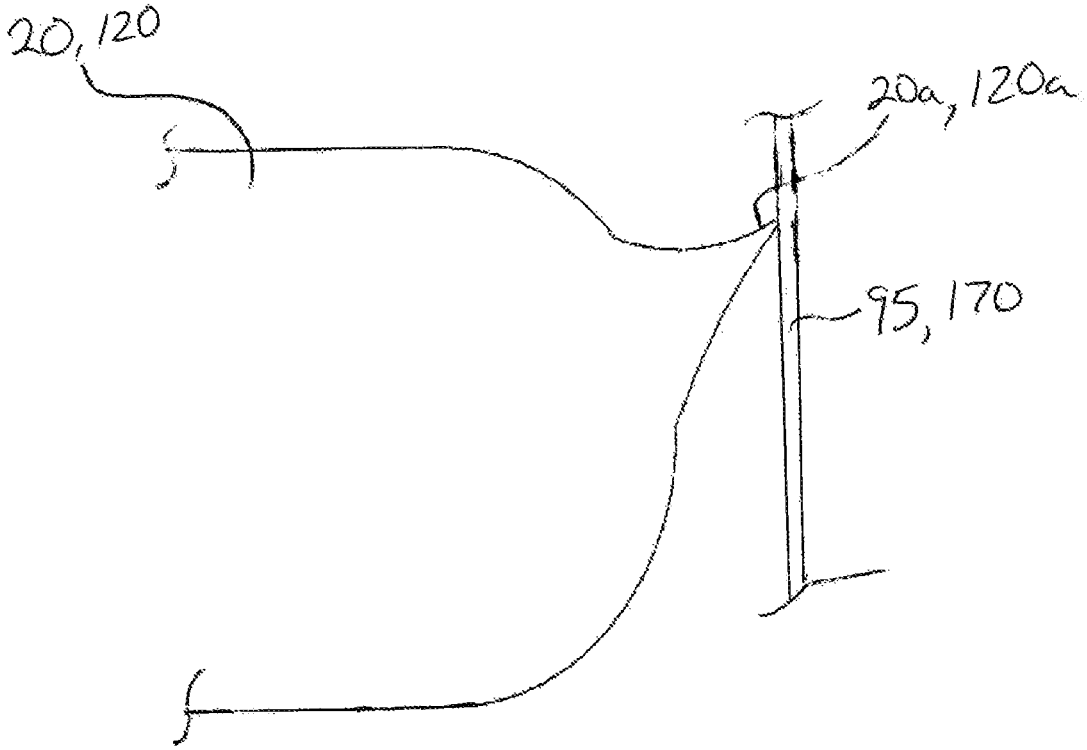
FIG. 20 is an enlarged side view of a portion of a seal element of embodiments of the device of the present disclosure engaging a side wall of a drain.

In some embodiments, the bottom seal elements 20, 120 comprise a tapered sealing ridge 20*a*, 120*a* formed on the outer edge thereof. This tapered sealing ridge 20*a*, 120*a* may provide the seal or added sealing between the side wall 95, 170 of the drain pipe 94, 164 and the bottom seal element 20, 120 when the device 10, 100 is inserted into the drain pipe 94, 164, as shown in FIG. 20. The tapered sealing ridge 20*a*, 120*a* prevents the flow of water around the bottom seal element 20, 120 of the straining device 10, 100.

The seal between the seal element 20, 120 and the side wall of a drain pipe forces water to pass through at least one of the openings 18, 24, 114, 118, 124, and or the slots 26, if used.

The size and spacing of the openings prevents or substantially prevents hair in the water from passing through the openings, particularly long hair. In some embodiments, the size and/or spacing of the opening prevents or substantially prevents hairs that are longer than 1.5 inches from passing through the openings. The tapered sealing ridge 20*a*, 120*a* is preferably made of a somewhat resilient material to allow some flexing, as can be seen in FIG. 20, for example, on insertion into the drain pipe to provide a tight seal. As noted, the size of and spacing between the openings 18, 24, 114, 118, 124 prevents hair in the water from passing through these opening such that the hair accumulates on the top surface of the bottom seal element 20, 120 and around the sidewalls of the lower part of the central body 16, 116 out of sight of a user. In some cases, hair may accumulate on the top surface 126 of the central element 116. The shape of the central element 16, 116 and the ring shape of the bottom seal element 20, 120 encourage the hair to wrap around the central element such that it can easily be removed when necessary.

The straining device 10, 110 is preferably made of a somewhat resilient material such as silicon or other rubber like material, however, is not limited to any specific material. The material of the straining device 10, 110 may be colored to provide for a pleasing appearance, as desired. The straining device 10, 110 may be inserted deeper into the drain pipe than shown in FIGS. 12 and 18, if desired and depending on the embodiment and application. Further, the straining device 10, 110 may be inserted less deep into the drain pipe provided that at least the bottom seal element 20, 120 is positioned inside the drain pipe. In some embodiments and applications, the bottom seal element 20, 120 will be out of view when deployed in the drain pipe.

Figure 21:
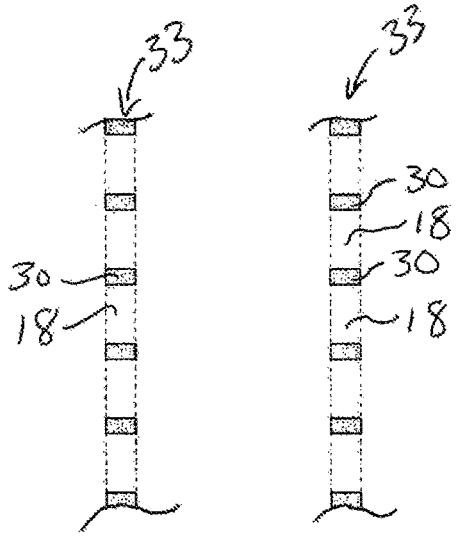
FIG. 21 is a cross-section view of a central element of a straining device of the present disclosure.
Figure 22:
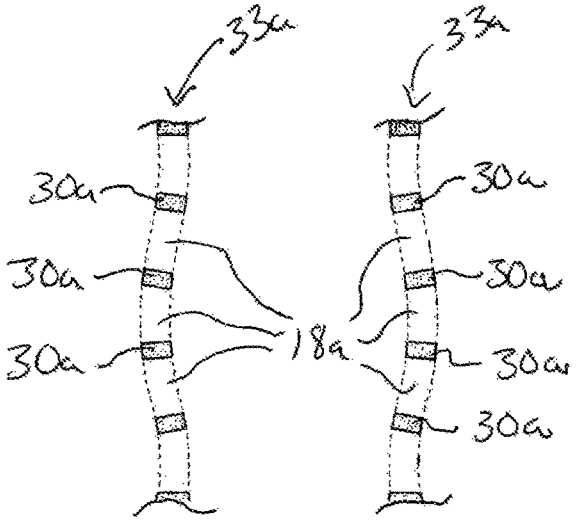
FIG. 22 is a cross-section view of a central element of a straining device in accordance with a third embodiment of the present disclosure.

The straining devices 10, 100 are shown having cylindrical sidewalls 30, 130 that are substantially straight and perpendicular, in cross-section, to the seal element 20, 120 as shown in some of the drawings. A section view, such as of FIG. 21, shows that opposite sections 33 of the sidewall 30 are parallel or substantially parallel. However, in some embodiments, such as shown in FIG. 22, the central cylinder may comprise a protruding sidewall 30*a* with openings 18*a*.

The straining device 10, 110 of the present disclosure provides for excellent straining performance while ensuring that unsightly accumulations of hair remain out of sight of the user. In addition, since hair tends to wrap around the central body 16 as it accumulates, removal of this hair from the straining device 10, 100 is relatively quick and easy after the device is removed from the drain. Thus, the straining device 10, 100 of the present application provides excellent straining functionality while providing an overall aesthetically pleasing appearance and easy cleaning.

From the foregoing, it will be observed that numerous variations and modifications may be effected without departing from the spirit and scope of the invention. It is to be understood that no limitation with respect to the specific apparatus illustrated herein is intended or should be inferred. For example, one or more component or embodiments may be combined, modified, removed, or supplemented to form further embodiments within the scope of the invention. As a further example, steps provided could be carried out in a different order to achieve desired results. Further, steps could be added or removed from the processes described. Therefore, other embodiments and implementations are within the scope of the invention.

The invention claimed is:

1. A hair straining device comprising:

a central tube;

an upper wall;

a lower wall;

the central tube comprising a tube body, a top opening, a bottom opening, a plurality of side openings and a hollow core;

the top opening and the bottom opening each axially traversing through the tube body;

the top opening and the bottom opening being aligned with each other;

the plurality of side openings laterally traversing through the tube body;

the plurality of side openings being located in between the top opening and the bottom opening;

the hollow core being surrounded by the tube body;

the hollow core being communicated with the top opening, the bottom opening and the plurality of side openings;

the upper wall comprising an upper body and an upper opening;

the upper body being connected with the tube body;

the upper body being adjacently positioned to the top opening;

the upper opening axially traversing through the upper body;

the upper opening being communicated with the top opening;

the lower wall comprising a lower body, a lower opening, a plurality of lower holes, a plurality of slots, a plurality of flaps and a plurality of ridges;

the lower body being connected with the tube body;

the lower body being adjacently positioned to the bottom opening;

the tube body being located in between the upper body and the lower body;

the lower opening axially traversing through the lower body;

the lower opening being communicated with the bottom opening;

the plurality of lower holes axially traversing through the lower body;

the plurality of lower holes being not communicated with the bottom opening and the lower opening;

the plurality of lower holes being distributed on the lower body;

the plurality of slots being not communicated with the bottom opening, the lower opening and the plurality of lower holes;

the plurality of flaps being perimetrically formed on the lower body by the plurality of slots axially traversing through and laterally traversing into and being perimetrically distributed on the lower body;

a corresponding flap among the plurality of flaps being located in between two corresponding adjacent slots among the plurality of slots;

a corresponding lower hole among the plurality of lower holes being located in between the lower opening and a corresponding flap among the plurality of flaps;

a corresponding lower hole among the plurality of lower holes being located in between two corresponding adjacent slots among the plurality of slots;

the plurality of ridges being perimetrically formed on the lower body;

a corresponding ridge among the plurality of ridges being terminally formed on a corresponding flap among the plurality of flaps;

each of the plurality of ridges being tapered towards the upper body; and the tube body, the upper body, the lower body, the plurality of flaps and the plurality of ridges each being made of a resilient material.

2. The hair straining device of claim 1, wherein each of the plurality of side openings is sized and positioned to substantially prevent hair from passing therethrough.

3. The hair straining device of claim 1, wherein each of the plurality of lower holes is sized and positioned to substantially prevent hair from passing therethrough.

4. The hair straining device of claim 1, wherein the lower body is ring shaped.

5. The hair straining device of claim 1, wherein the tube body is cylindrical.

6. The hair straining device of claim 1, wherein each of the plurality of ridges is configured to contact with a drain wall of a drain.

7. The hair straining device of claim 1, wherein each of the plurality of flaps is configured to contact with a drain wall of a drain.

8. The hair straining device of claim 1 comprising a top seal element, the top seal element being mounted on the upper body, the upper body being located in between the top seal element and the tube body.

9. The hair straining device of claim 8, wherein the top seal element comprises a cap, a central post and a hollow post core, the central post is connected to the cap, the central post is inserted into the upper opening, the hollow post core traverses into the central post, and the hollow post core is communicated with the hollow core.

10. The hair straining device of claim 9, wherein a diameter of the lower body is larger than a diameter of the tube body and smaller than a diameter of the cap.

11. The hair straining device of claim 9, wherein the top seal element comprises a fastener, and the top seal element is mounted on the upper body by the fastener being inserted into the hollow post core so as to engage the central post with the upper body.

12. The hair straining device of claim 9, wherein the top seal element comprises a ring projection, the ring projection is connected to the cap, and the ring projection contacts with the upper body.

13. The hair straining device of claim 1 comprising a pair of arms, the pair of arms extending laterally from the tube body, the pair of arms each being separate from the upper wall, the pair of arms being configured to contact with a drain.

14. The hair straining device of claim 13, wherein each of the pair of arms comprises a first portion and an arrow portion, the first portion is connected to the tube body, the arrow portion is connected to the first portion, the first portion is located in between the tube body and the arrow portion, the arrow portion comprises a curved tip, and the curved tip is positioned away from the tube body.

15. The hair straining device of claim 13, wherein each of the pair of arms is made of a resilient material.

16. The hair straining device of claim 13, wherein the pair of arms are adjacently positioned to top opening, and the pair of arms extend from opposite sides of the tube body.

17. The hair straining device of claim 1 comprising a pair of arms, the pair of arms extending from the upper body, the pair of arms being configured to contact with a drain.

18. The hair straining device of claim 17, wherein the pair of arms are connected to each other.

19. The hair straining device of claim 17, wherein the pair of arms are positioned across the upper body.

20. The hair straining device of claim 1, wherein the upper wall comprises a plurality of upper holes, the plurality of upper holes axially traverse through the upper body, and the plurality of upper holes are communicated with the top opening.

21. The hair straining device of claim 20, wherein each of the plurality of upper holes is sized and positioned to substantially prevent hair from flowing therethrough.

22. The hair straining device of claim 17, wherein each of the pair of arms is made of a resilient material.

* * * * *